United States Patent [19]

Ikeda

[11] Patent Number: 4,808,962

[45] Date of Patent: Feb. 28, 1989

[54] FUSE

[75] Inventor: Tomohiro Ikeda, Shizuoka, Japan

[73] Assignee: Yazaki Corporation, Japan

[21] Appl. No.: 126,488

[22] Filed: Nov. 30, 1987

[51] Int. Cl.[4] ..... H01H 85/02; H01H 85/14

[52] U.S. Cl. ..... 337/203; 337/249

[58] Field of Search ..... 337/203, 249, 250

[56] References Cited

U.S. PATENT DOCUMENTS

| | | | |
|---|---|---|---|
| 4,047,142 | 9/1977 | Burnatt et al. | 337/186 |
| 4,544,907 | 10/1985 | Takano | 337/295 |

FOREIGN PATENT DOCUMENTS

| | | | |
|---|---|---|---|
| 28246 | of 1897 | United Kingdom | 337/203 |
| 354049 | 8/1931 | United Kingdom | 337/203 |
| 367350 | 3/1932 | United Kingdom . | |
| 454977 | 11/1936 | United Kingdom . | |
| 513445 | 10/1939 | United Kingdom . | |
| 555767 | 9/1943 | United Kingdom . | |
| 1024192 | 3/1966 | United Kingdom . | |

*Primary Examiner*—H. Broome

*Attorney, Agent, or Firm*—Wigman & Cohen

[57] ABSTRACT

A fuse comprises a housing formed of synthetic resin, and the housing including a peripheral wall having an upper opening, a fuse-element, which is melted by an excessive electrical current flowing therethrough, fixedly disposed in the housing and at least an air passage communicating between the inside and outside of the housing and formed on the wall portion of the housing. A heated air in the housing heated by heat generated in the fuse-element is discharged from the air passage, thereby it is prevented that the inside of the housing becomes high-temperature.

7 Claims, 4 Drawing Sheets

FUSE

BACKGROUND OF THE INVENTION

1. Field of the Invention

This invention relates to a fuse, more particularly to an improvement of a fuse of the type which is used in vehicles such as automobiles to protect electrical power circuits therein in which relatively large amount of electric current flows.

2. Description of the Prior Art

In a vehicle such as an automobile, electrical power is usually supplied from a battery mounted therein, and various fuses are disposed to protect the battery from shorts. In particular, in an electrical circuit of an automobile in which relatively large amount of electric current flows, a fuse of the type as described in FIGS. 1 and 2 is generally used to protect electrical equipments and an electrical power source from a burning caused by excessive electric current.

Specifically, as shown in FIGS. 1 and 2, said known fuse 10 comprises a housing 11 of heat resistant synthetic resin and a fuse element 12 disposed in said housing 11, a pair of fuse contacts 13 and 13 each connected at one end thereof to both ends of the fuse element 12, respectively. The other ends of the fuse contacts 13 and 13 are protruded through a bottom plate 11*a* of the housing 11 outside in parallel with each other when assembled. Cable terminals 14 and 14 each attached to the end of a wire are connected to the fuse contacts 13 and 13, respectively, by fastening means such as a bolt.

In such a fuse 10, usually a housing cover 15 is attached on an upper opening space of the housing 11 to protect the fuse element 12 from external substances such as suspended dusts or the like which is apt to damage the fuse element, so that the inside of the housing is generally kept airtightly. Therefore, the inside of the housing 11 is apt to become high temperature by a heat generated by electric current flowing through the fuse element 12. Because of this, as a material which forms the housing 11, a heat resistant synthetic resin such as a nylon resin reinforced by fiberglass is usally used.

In the fuse as described above, the fuse element 12 is in an instant melted if excessive electric current flows therethrough. On the oher hand, if the amount of electric current is relatively smaller than that of the excessive current, the time required for melting the fuse element 12 (hereinafter referered to a "melting time") becomes long. The relationship between the magnitude of the electric current and the melting time is indicated by the line "A" in FIG. 3. As shown in the drawing, when an electric current $I_1$ (hereinafter referred to as "non-melting electric curent") which is slightly larger than the rated current $I_o$ flows in the fuse-element 12, the fuse element 12 does not melt although it is heated and the generation of the heat is continued. As a result, the inside of the housing 11 becomes high temperature, so that there were disadvantages that thermal deformation may be caused in the housing 11 by an external force or an accident that only a part of the fuse element is melted may be happened.

SUMMARY OF THE INVENTION

An object of this invention is to provide a fuse which can prevent thermal deformation of a housing of a fuse from causing by a high temperature over a heat resistant capacity of the housing which is and caused by the non-melting electric current flowing in a fuse-element.

Another object of the present invention is to provide a fuse which can discharge heated air in the housing outside.

In order to achieve the above objects, the fuse according to the present invention comprises a housing formed of synthetic resin, and said housing including a peripheral wall having an upper portion, a fuse-element, which is melted by an excessive electric current flowing therethrough, fixedly disposed in the housing and at least one air passage communicating between the inside and outside of said housing and provided on said upper portion of said wall of the housing.

It is preferable that the air passage provided on the upper portiton of the wall portion of the housing is meandered so as not to look into the inside from the outside of the housing through the air passage. Further, it is also preferable that such a air passage is provided more than two. However, it is enough that only one air passage is provided if there are any spaces around portions where the fuse contacts of an element pass through the housing.

In the fuse comprising such a housing having at least one air passage described above, air heated by the heat generated in the fuse element is flowed out through the air passage. Therefore, it is possible to prevent the inside of the housing from becoming high temperature by the heat. In particular, since the air passage is formed on the upper portion of the wall portion of the housing, it makes easy to discharge the heated air outside due to the heated air being circulated toward upward by a convection.

The fuse according to the present invention, since the air passage is formed meanderously, there is little possibility that external substances such as suspended dusts enter into the housing and damage the fuse-element. Further, since high temperature air does not stay in the housing, it is possible to prevent an occurrence of thermal deformation of the housing even if the non-melting electric current flows in the fuse-element during long time. Furthermore, in a case where the air passage is provided on the housing, the temperature of the fuse-element may be slightly dropped and the melting time is extended as shown by the line "B" in FIG. 3. However, this does not give any influence to the capacity of the fuse when excessive electric current $I_2$ flows in the fuse element.

These and other object and advantages of the present invention, as well as the details of illustrative embodiments, will be more fully understood from the following specification and drawings, in which:

DETAILED DESCRIPTION OF THE PREFERRED EMBODIMENT

Figure 1:
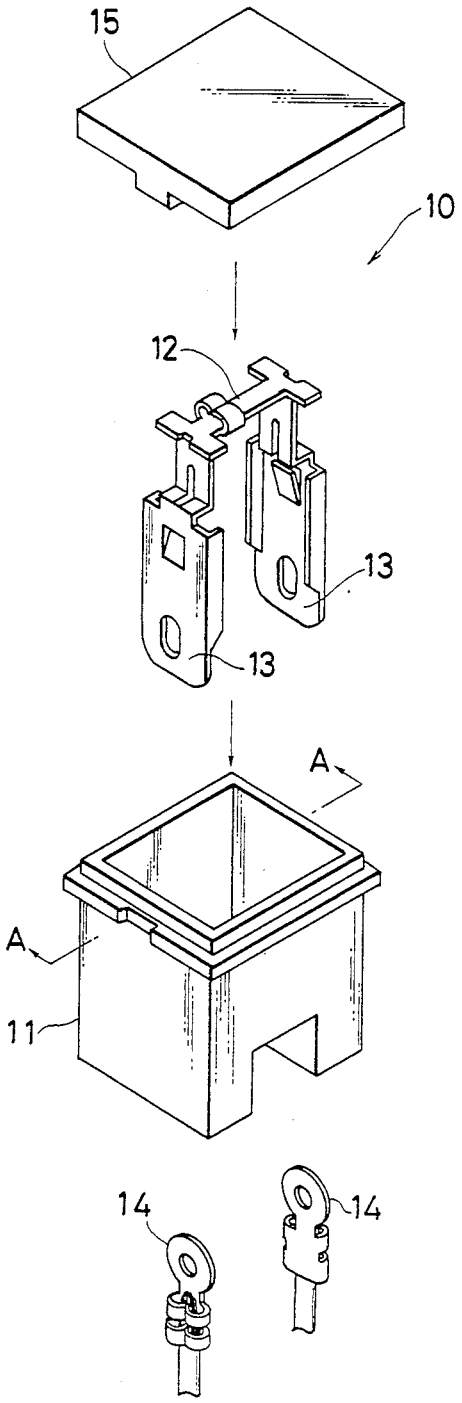
FIG. 1 PRIOR ART
FIG. 1 is a disassembled perspective view showing the structure of the conventional fuse.
Figure 2:
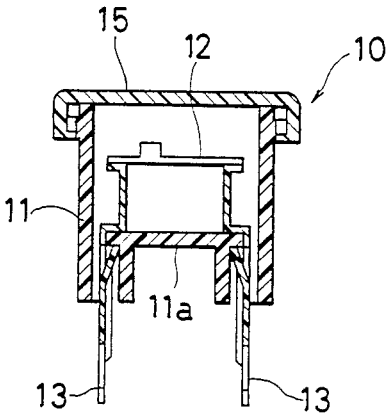
FIG. 2 PRIOR ART
FIG. 2 is a section view taken along the line A—A of FIG. 2.
Figure 3:
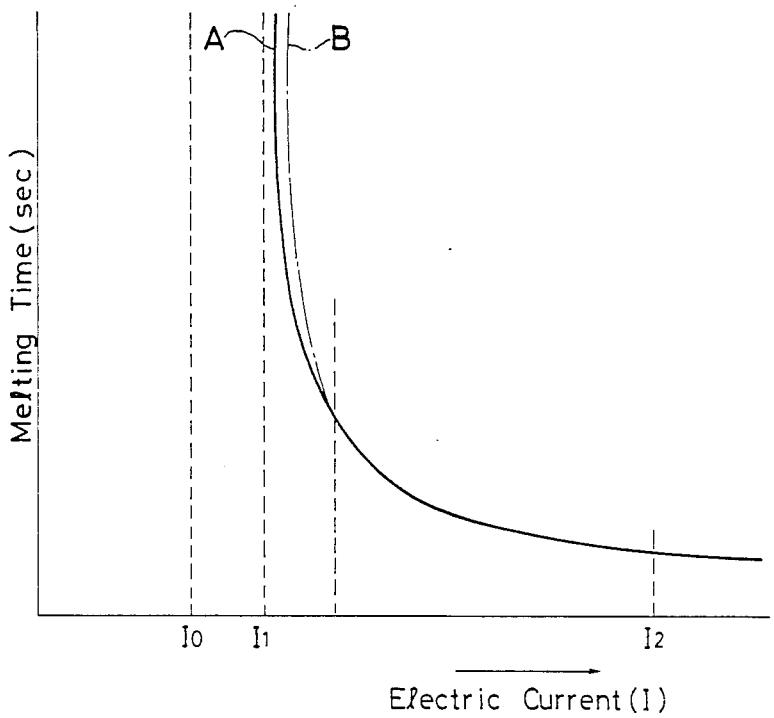
FIG. 3 is a graph showing the relationship between electrical current flowing through a fuse-element and the melting time of the fuse-element.
Figure 4:
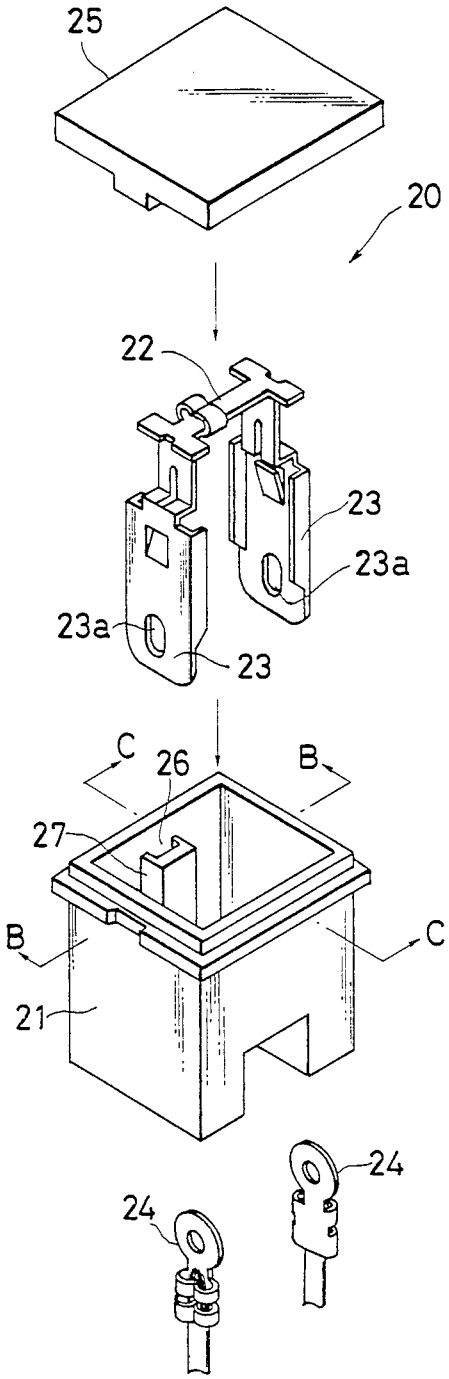
FIG. 4 is a disassembled perspective view showing the structure of a fuse of the first embodiment according to the present invention.
Figure 5:
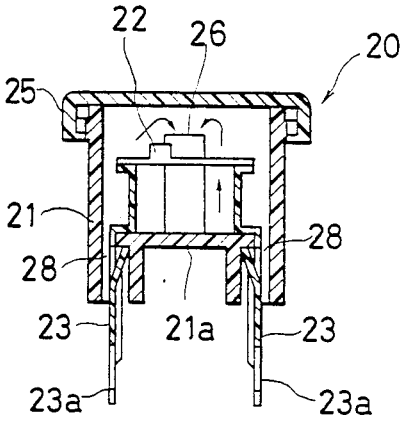
FIG. 5 is a section view taken along the line B—B of FIG. 4.
Figure 6:
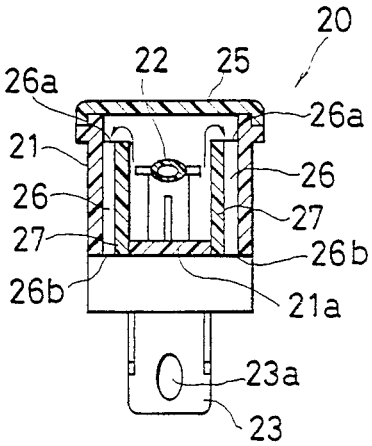
FIG. 6 is a section view taken along the line C—C of FIG. 5.

Referring now to the drawings of FIGS. 4 to 6, the first embodiment of this invention is illustrated.

Specifically, as shown in FIG. 4, said fuse 20 comprises a housing 21 which is formed of heat resistant synthetic resin. Said housing 21 has a box-shaped configuration, and an upper side of the housing 21 is opened so as to form an opening. A fuse-element 22 which is melted by an excessive electric current over the rated current is disposed in said housing 21. A pair of fuse contacts 23 and 23 are connected at one end thereof to both ends of the fuse element 22, respectively. Each of fuse contacts 23 and 23 has a bolt hole 23*a*, respectively. The other ends of the fuse contacts 23 and 23 are protruded through a bottom plate 21*a* of the housing 21 outside in parallel with each other when assembled. Cable terminals 24 and 24 each attached to the end of a wire are connected to the fuse contacts 23 and 23 by fastening means such as bolt. A housing cover 25 is attached on the housing 21 so as to cover the upper opening of the housing 21. Said cover 25 has a function to protect the fuse element 22 from external substances such as suspended dusts or the like. Therefore, the inside of the housing 21 is closed so that it is apt to become high temperature by a heat generated in the fuse element 22.

In the inside of the housing 21 two air passages 26 and 26 are provided on the opposite inner surfaces of the housing longitudinally. Each of said air passages 26 is formed by mounting a channel forming member 27 having C-shaped cross section and a longitudinal recess onto the inner surface of the housing 21, so that the air passage is formed on the inside of the channel forming member 27. Therefore, the air passage 26 has an inlet 26*a* located on the upper side of the housing and communicating with the inside of the housing 21, and an outlet 26*b* located on the underside of the housing and communicating with the outside of the housing 21. Further, the air passage 26 is opposed at the upper portion thereof to the housing cover 25, thereby being meandered, so that it is not possible to look into the inside of the housing 21 through the passage from the outside thereof.

In addition, in the portions where fuse contacts 23 and 23 are passed through the bottom plate 21*a* of the housing 21, there are provided spaces 28 and 28, so that a heat generated by the fuse element 22 is easily circulated toward the upper side and wafted outside through the air passage 26, thereby a temperature rise in the inside of the housing 21 which is caused by heated air generated by a heat in the fuse-element is suppressed. On the other hand, there is little possibility that the fuse element 22 is damaged by external substances such as suspended dusts, since the dusts can not enter into the inside of the housing 21 through the air passage 26.

Figure 7:
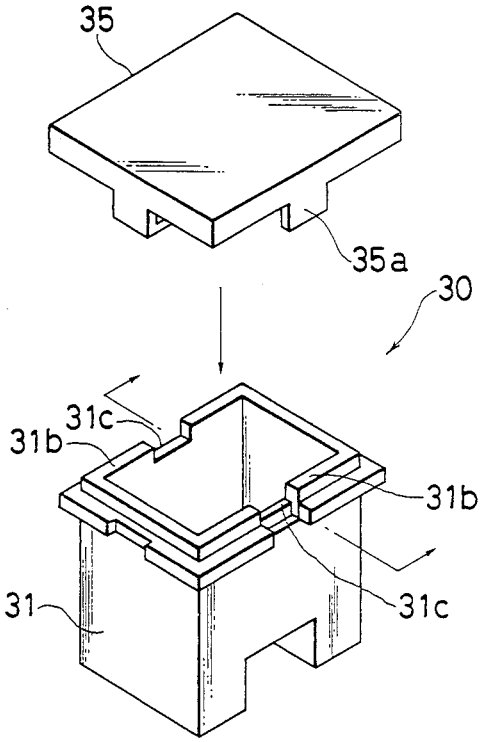
FIG. 7 is a disassembled perspective view showing the structure of a fuse of the second embodiment.
Figure 8:
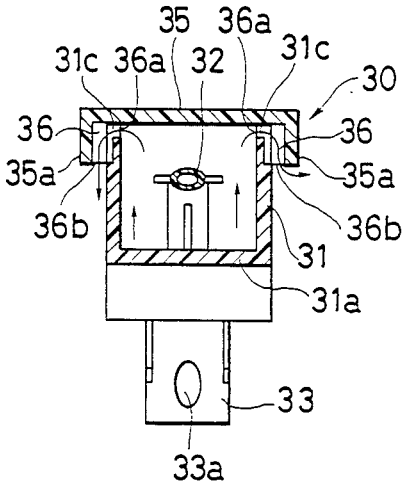
Fig.8 is a section view taken along the line D—D of FIG. 7.

Referring now to the drawings of FIGS. 7 and 8, the other embodiment of a fuse 30 of the present invention is illustrated.

In this embodiment, the fuse 30 comprises a housing 31 of heat resistant synthetic resin. Said housing 31 has a box-shaped configuration, and an upper side of the housing 31 is opened so as to form an opening. A fuse-element 32 which is melted by an excessive electric current over the rated current is disposed in said housing 31. A pair of fuse contacts 33 and 33 are connected at one end thereof to both ends of the fuse element 32, respectively. Each of fuse contacts 33 and 33 has a bolt hole 33*a*, respectively. The other ends of the fuse contacts 33 and 33 are protruded from a bottom plate 31*a* of the housing 31 downwardly in parallel with each other when assembled. Cable terminals (not shown) each attached to the end of a wire are connected to the fuse contacts 33 and 33 by fastening means such as a bolt. The above structure of the fuse of this embodiment is same as that of the first embodiment.

On opposite edges 31*b* and 31*b* at the upper side of the housing 31, there are formed notches 31c and 31*c*, respectively. A housing cover 35 is attached on the housing 31 so as to cover the upper opening of the housing 31. Said cover 35 has a shielding plates 35*a* and 35*a* provided on the both sides thereof which correspond to the positions of the opposite edges 31*b* and 31*b*, which can cover the notches 31*c* and 31*c*, respectively, when the housing cover 35 is attached to the housing 31. As a result, two air passages 36 and 36 are formed by the notches 31*c* and 31*c* and spaces between the housing 31 and each shielding plate 35*a* and 35a, respectively. Further, each air passage 36 has an inlet 36*a* which communicates with the inside of the housing 31 and an outlet 36*b* which communicates with the outside of the housing 31.

Although a shape of the air passage 36 of this embodiment is different from that of the first embodiment, the function thereof is almost the same as that of the first embodiment. Specifically, since the inlet 36*a* of the air passage 36 is located at the upperside in the housing 31 and the outlet 36*b* is located at the outside of the housing 31 and directed downwardly, it makes easy to discharge heated air heated by the fuse-element which is likely circulated toward upward. Further, thus formed air passage 36 is meandered, it is not possible to look into the inside of the housing 31 through the passage 36 from the outside, so that external substances such as suspended dusts can not enter into the housing 31.

Figure 9:
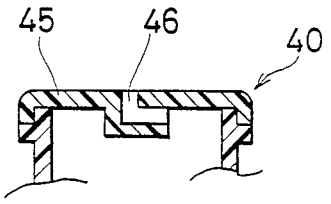
FIG. 9 is a section view of a fuse of the third embodiment.

FIG. 9 shows the third embo diment of a fuse 40 of the present invention. In this embodiment, an air passage 46 such a manner as shown in the drawing is formed on a housing cover 45 of the fuse 40. The air passage 46 is meandered such that it is not possible to look into he inside of the housing through the passage from the outside as shown in the drawing. Therefore, the same function as those of the above embodiments is expected.

It must be understood that the invention is in no way limited to the embodiments and that many changes may be brought therein without departing from the scope of the invention as defined by the appended claims.

What is claimed is:

1. A fuse comprising:

a housing formed of synthetic resin, and said housing including a peripheral wall having an inner surface, an upper portion, and an upper opening;

a housing cover for covering said upper opening of the housing;

a fuse-element, which is melted by an excessive electric current flowing therethrough, fixedly disposed in said housing; and at least one channel forming member disposed on the inner surface of the peripheral wall, said channel forming member having a longitudinal groove forming an air passage that communicates between the inside and the outside of said housing in order to discharge heated air heated by said fuse-element to the outside of said housing.

2. A fuse as set forth in claim 1, wherein said air passage is formed so as to prevent external substances from entering the inside of said housing through said air passage from the outside of said housing.

3. A fuse as set forth in claim 1, wherein said air passage has two ends, and an inlet is formed on one end which is located in the upper portion of said housing and an outlet is formed on the other end which is located at the outside of said housing.

4. A fuse as set forth in claim 1, wherein said housing has a bottom plate, and at least one space which can intake air in the outside of said housing into the inside of said housing is formed between said bottom plate and the inner surface of the peripheral wall of said housing.

5. A fuse as set forth in claim 2, wherein the peripheral wall also has a lower portion, and the air passage has an internal port located at the upper portion of the peripheral wall, for communicating with the inside of the housing, and an external port located at the lower portion of the peripheral wall, for communicating with the outside of the housing.

6. A fuse comprising:

a housing formed of synthetic resin, said housing including a peripheral wall having an upper opening;

a housing cover for covering said upper opening of the housing;

a fuse-element, which is melted by an excessive electric current flowing therethrough, fixedly disposed in said housing;

at least one air passage that communicates between the inside and the outside of said housing in order to discharge heated air heated by said housing to the outside of said housing;

wherein said housing has edges around said upper opening and at least one notch is formed on said edges, and said housing cover has at least one shielding plate which covers the notch and forms a space between the shielding cover and the housing when said cover is attached on said housing, and said air passage is formed by the notch and the space.

7. A fuse as set forth in claim 6, wherein said air passage has an inlet provided in said notch and an outlet provided in said space, and said inlet communicates with the inside of said housing and said outlet communicates with the outside of the housing, and is located under the inlet and turned downwardly.

* * * * *